United States Patent [19]

Weaver

[11] 4,309,697

[45] Jan. 5, 1982

[54] MAGNETIC SURVEILLANCE SYSTEM WITH ODD-EVEN HARMONIC AND PHASE DISCRIMINATION

[75] Inventor: Jon N. Weaver, Boca Raton, Fla.

[73] Assignee: Sensormatic Electronics Corporation, Deerfield Beach, Fla.

[21] Appl. No.: 193,038

[22] Filed: Oct. 2, 1980

[51] Int. Cl.³ ..... G08B 13/22

[52] U.S. Cl. ..... 340/572; 340/551

[58] Field of Search ..... 340/572, 551

[56] References Cited

U.S. PATENT DOCUMENTS

| | | | |
|---|---|---|---|
| 3,559,201 | 1/1971 | Hilliard | 340/572 |
| 3,747,086 | 7/1973 | Peterson | 340/572 |
| 3,983,552 | 9/1976 | Bakeman, Jr. et al. | 340/572 |
| 4,063,230 | 12/1977 | Purinton et al. | 340/572 |

FOREIGN PATENT DOCUMENTS

| | | | |
|---|---|---|---|
| 763681 | 2/1934 | France | 340/572 |

*Primary Examiner*—Glen R. Swann, III

*Attorney, Agent, or Firm*—Hopgood, Calimafde, Kalil, Blaustein & Judlowe

[57] ABSTRACT

Apparatus for detecting the presence within a surveillance zone of a body of high permeability material creates a surveillance field varying sinusoidally at a fundamental frequency. Parallel filter channels select the second and third harmonic components of the perturbations created by said material when present in the field and the phase of the second harmonic relative to a reference signal is compared. The signal level of each of the second and third harmonic components as well as the aforesaid phase congruency cooperatively control an alarm circuit. Rhomboid shaped transmitter coils surrounding figure "8" receiver coils improve coupling to the high permeability body.

16 Claims, 5 Drawing Figures

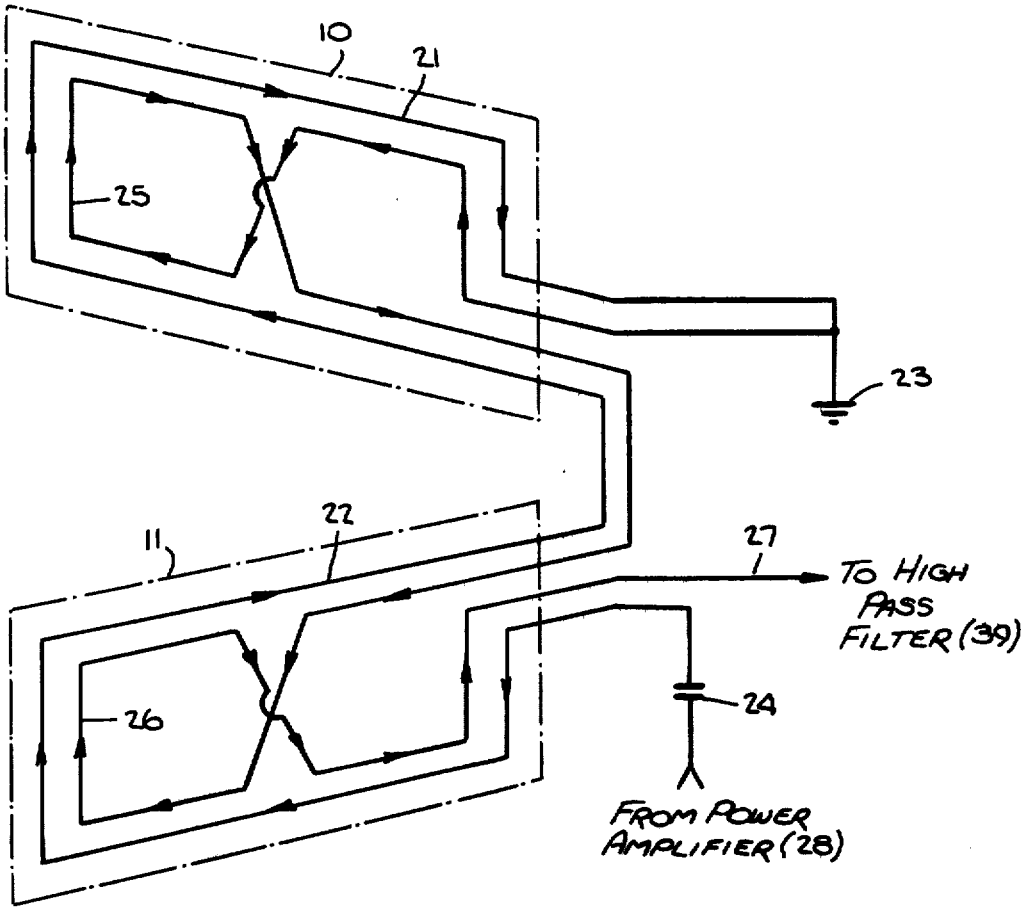
Fig. 3.
Fig. 5.
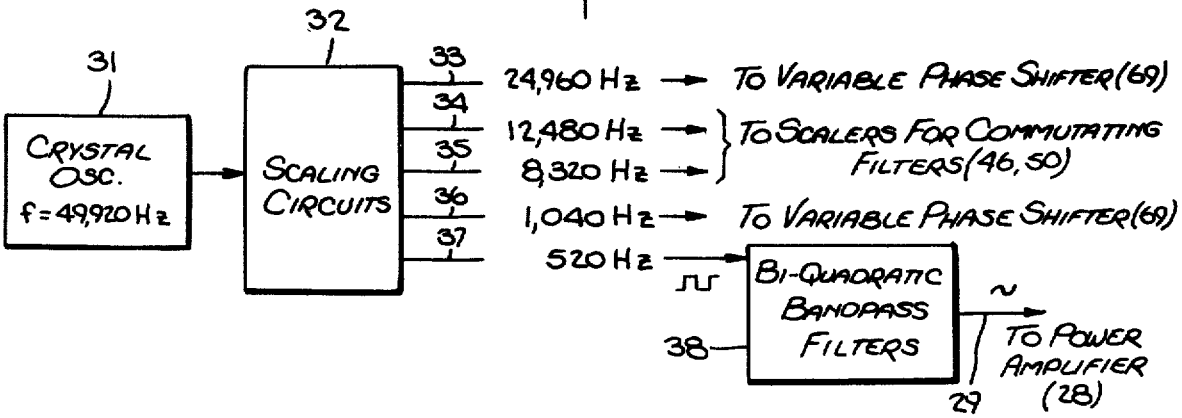

MAGNETIC SURVEILLANCE SYSTEM WITH ODD-EVEN HARMONIC AND PHASE DISCRIMINATION

BACKGROUND OF THE INVENTION

The present invention relates to apparatus for detecting the presence of an object within a surveillance zone and more particularly to apparatus employing a varying magnetic field for detecting a body of high permeability material.

In French Pat. No. 763,681 granted to Mr. Pierre Arthur Picard on Feb. 19, 1934 there is described apparatus for locating objects by modifying a magnetic field. The different characteristics of conductive, resistive, low permeability and high permeability material are discussed, it being observed that in a varying magnetic field magnetized iron will produce perturbations containing even harmonics of the field frequency, while other permeable material will produce signals containing odd harmonics with greater permeability giving rise to higher order odd harmonics.

Detection of such material is accomplished generally by measuring the amplitude and phase of an odd harmonic relative to that of the field producing fundamental frequency signal. In the described transmitter, undesirable harmonics are eliminated first by tuning the transmitting coil in a series resonant circuit. In the receiver, a filter eliminates the fundamental frequency and any undesired harmonics and passes selectively the desired harmonics. For example, a piece of permalloy can be detected by passing the eleventh harmonic and all higher harmonics. On the other hand, a magnetized metal piece can be detected by measuring the even harmonics. It is also observed that detection may be effected by determining the quotient of the values of the fundamental frequency and its harmonic or harmonics, or the quotient of the harmonics alone.

Various coil structures are described in said French patent for transmitting and receiving the electromagnetic signals. In one embodiment a figure "8" coil frame is used for transmission while a rectangular coil frame is used for reception, and in another embodiment the coil frames are interchanged with the rectangular frame being used for transmission and the figure "8" frame being used for reception.

Subsequent to the granting of the Picard French patent, others have attempted to improve upon the so-called magnetic detection system. For example, in Bakeman, Jr. et al. U.S. Pat. No. 3,983,552, issued Sept. 28, 1976, there is disclosed a pilferage deterrent marker of laminated construction containing an easily magnetized layer of Permalloy and a control layer of difficult to magnetize Vicalloy or Remendur. Such marker, when the control layer is magnetized, is detected by a circuit responding to the amplitude and phase of the received second harmonic signal. That is, the phase of the incoming signal is compared with the phase of a local reference signal and if it is either in phase or 180° out of phase and exceeds a given amplitude, an alarm will be triggered. Said Bakeman, Jr. et al. patent observes that when their control element is demagnetized there is practically no contribution from the even harmonics. What is present, apparently, is undetectable and is speculated as possibly due to the fact that a small bias may still remain due to the magnetic field of the earth or other magnetized objects.

In Purinton et al. U.S. Pat. No. 4,063,230, issued Dec. 13, 1977, there is described a system that monitors both the amplitude and the phase of the incoming signal and that triggers an alarm when both quantities fall within a predetermined range. The patent does not disclose the frequencies or harmonics that are employed. The antennas or coils are located in "facades" disposed in parallel relationship on opposite sides of a passageway to be controlled.

The intent of all the prior workers has been to improve the reliability of detection of the special high permeability tags or markers while avoiding false alarms associated with other objects having similar but not identical conductive and magnetic properties. Unfortunately, certain of the techniques employed give rise to other problems encountered in pilferage control. A viable system must reliably respond to the marker when the marker is within the surveillance zone but must not be triggered by markers outside of the zone, and it must be possible to confine the zone to a reasonable area. Confining the area covered can be accomplished by minimizing the transmitted power and selecting appropriate directional coil geometry. However, this is not a simple problem to solve because it is also necessary that the system be effective to detect the presence of a marker regardless of its orientation within the surveillance zone relative to the transmitting and receiving coils.

With the foregoing in mind, it is an object of the present invention to provide apparatus employing a varying magnetic field for detecting a marker which apparatus is adapted to couple effectively with markers within a surveillance zone substantially independent of the orientation of the latter and which functions with comparatively low power, considering the frequencies involved, so as to confine the interrogating field substantially to the surveillance zone.

SUMMARY OF THE INVENTION

It has been discovered that under suitable conditions of excitation, the earth's magnetic field is sufficient to cause a body of high permeability material to produce field perturbations containing sufficient even and odd harmonic energy, particularly the second and third harmonic, that such energy can be used as a reliable basis for discriminating between a specifically dimensioned sample of said material and routinely encountered metal objects. By virtue of the selectivity afforded by the subject apparatus, the radiated or transmitted power can be kept comparatively low. A carefully configured coil arrangement couples effectively with such body substantially independent of the orientation of the latter within the surveillance zone.

In accordance with the present invention there is provided apparatus for detecting the presence within a surveillance zone of a body of high permeability material, the latter being constructed, when linked in said zone with both a magnetic field varying at a fundamental frequency and the substantially constant magnetic field of the earth, to produce a detectable signal containing both odd and even harmonics of said fundamental frequency, said apparatus comprising means for establishing in said zone said varying magnetic field, means for coupling to said zone to detect signals produced by said body, means coupled to said coupling means for separately determining for a detected signal the respective amplitude of a first and second component thereof whose respective frequencies are equal to two different harmonics of said fundamental frequency where one harmonic is odd and the other is even, said determining means including means for determining the phase of said first component, and means coupled to all of said determining means for furnishing an indication of the presence of said body within said zone whenever said amplitudes and phase simultaneously fall within respective predetermined limits.

Further in accordance with the present invention, the means for establishing the varying magnetic field and the means to detect signals produced by the body of high permeability material comprise an integrated antenna structure containing both transmitting and receiving coils equally divided between two panels which panels are constructed and arranged to be mounted in parallel planes on opposite sides of a pathway containing the surveillance zone, said panels each containing a transmitting coil in the shape of a rhomboid and a receiving coil in the shape of a figure "8", the latter being balanced to cause cancellation of any signal received directly from its associated transmitting coil.

BRIEF DESCRIPTION OF THE DRAWINGS

The invention will be better understood after reading the following detailed description of the presently preferred embodiment thereof with reference to the appended drawings in which:

FIG. 3 is a schematic diagram of the transmitting and receiving coils as disposed within the rhomboid panels;

FIG. 5 is a further electrical block diagram illustrating a detail of the system of FIG. 4.

The same reference numerals are used throughout the drawings to designate the same or similar parts.

DESCRIPTION OF THE PREFERRED EMBODIMENT

Figure 1:
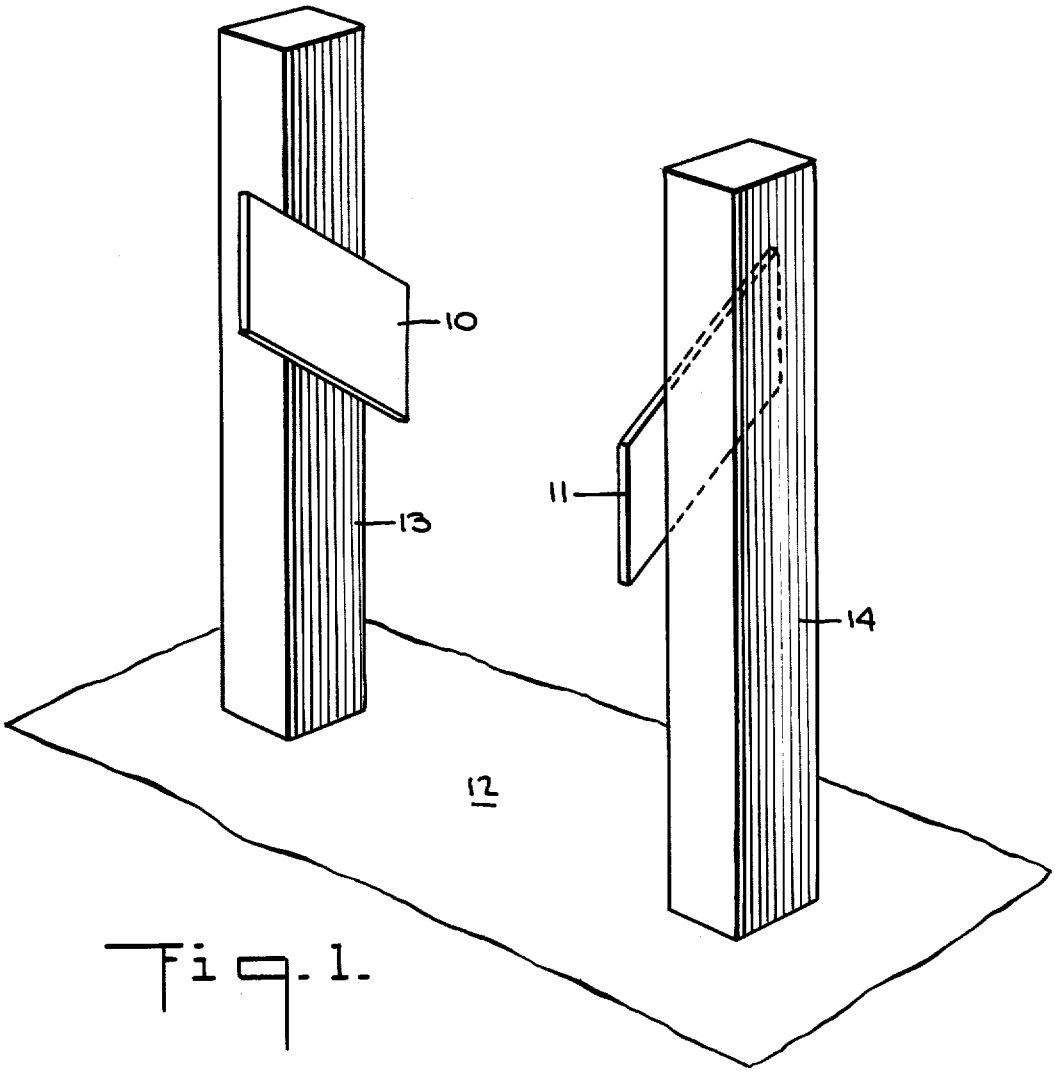
FIG. 1 is a perspective view showing the two rhomboid shaped panels containing the transmitting and receiving coils as they would appear mounted on opposite sides of a pathway containing a surveillance zone.

Referring to FIG. 1 of the drawings, a pair of rhomboid shaped panels 10 and 11 are shown mounted in parallel planes on opposite sides of a pathway 12 containing the zone to be maintained under surveillance. For the purpose of illustration the panels 10 and 11 are shown mounted on respective columns or supports 13 and 14 which may either be provided separately for the purpose or constitute part of the jambs of a doorway or the like. When separate columns are utilized they may also house the electronic circuitry that will be described hereinafter. In a presently preferred embodiment of the subject invention, the panels 10 and 11 may be spaced apart approximately 36 inches.

Figure 2:
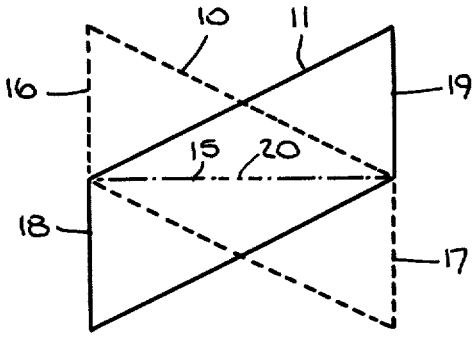
FIG. 2 is a diagramatic view showing the relative orientation of one panel with respect to the other panel.

The panels 10 and 11 are so shaped and positioned that when viewed along a line normal to their respective planes they will appear as shown in FIG. 2. For the sake of clarity in FIG. 2 panel 10 has been illustrated in dashed lines while panel 11 has been shown in solid lines. It should be observed that panels 10 and 11 are congruent with the shorter diagonal of each rhomboid, here represented by the dot-dash line 15, perpendicular to the shorter sides, 16 and 17 for panel 10, and 18 and 19 for panel 11. With the illustrated mounting, the shorter diagonals 15 lie in a common plane normal to the planes of the rhomboids 10 and 11. Although not specifically illustrated, it should be apparent that the longer diagonals of the rhomboids 10 and 11 lie in separate planes that intersect each other and the common plane, previously identified, along a common straight line passing through the point 20.

Referring now to FIG. 3 wherein the panels 10 and 11 are shown in dot-dash lines, it may be seen that the panels 10 and 11 include an integrated antenna structure containing both transmitting and receiving coils equally divided between the two panels. The transmitting coils 21 and 22, shown schematically in FIG. 3, are each rhomboid shaped and may closely parallel the periphery of the respective panel 10 and 11. Each of the coil portions 21 and 22 may consist of a series of turns so wound such that when coil 21 is connected in series with coil 22 between ground at 23 and capacitor 24 the current during alternate half cycles of the energizing signal will flow in the direction of the arrows. The receiving coils are shown at 25 and 26, each configured in the shape of a figure "8", disposed within the respective transmitting coil, as shown. Receiving coils 25 and 26 are connected in series between ground 23 and a lead 27, with the windings oriented such that during alternate half cycles of a received signal the current will flow in the direction of the arrows shown in the drawing. The receiving coils 25 and 26 should be balanced to cause cancellation of any signal received directly from its associated transmitting coil 21 and 22, respectively. With proper symmetry the receiving coils will also be balanced with respect to any prevailing ambient interference that is not so directional as to affect differently individual portions of the coil.

The capacitor 24 is chosen to resonate the inductance of the transmitter coils 21 and 22 providing a series resonant circuit having a "Q" of approximately 10. When used with targets consisting of straight strips of high permeability material the rhomboid configuration of the antenna coil results in improved detection of vertically oriented targets.

Figure 4:
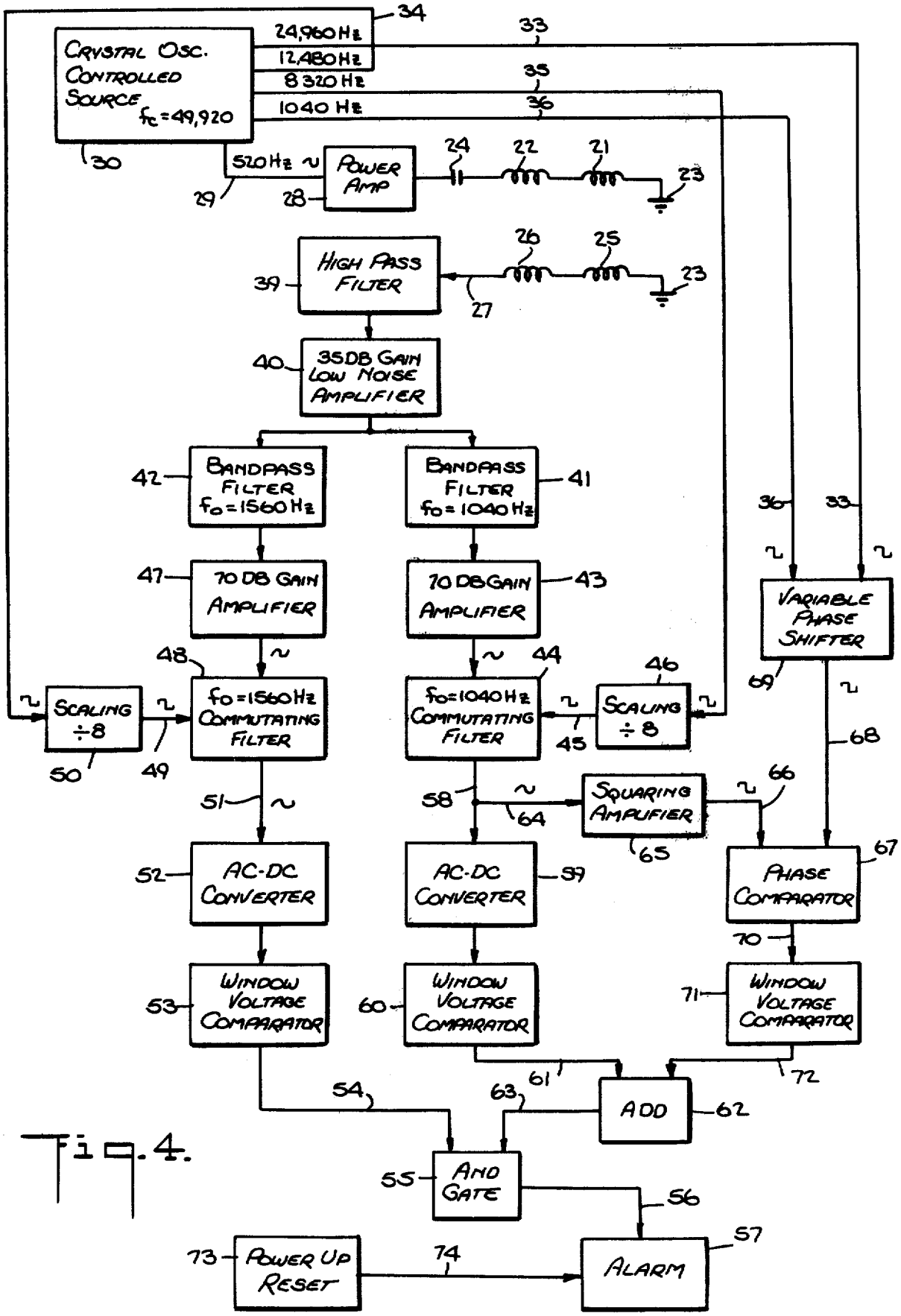
FIG. 4 is an electrical block diagram of the system embodying the present invention.

Referring now to FIG. 4 of the drawings, it will be seen that capacitor 24 is coupled to the output of a power amplifier 28 furnished with a sinusoidal signal having a frequency of 520 Hz. over lead 29 from a crystal oscillator controlled source 30.

As shown in FIG. 5 the crystal oscillator controlled source 30 contains a crystal oscillator 31 operating at a frequency of 49,920 Hz. supplying a series of scaling circuits 32 producing squarewave signals on leads 33, 34, 35, 36 and 37 having the frequencies as shown in the drawings. Thus, after dividing by two the signal on lead 33 has a frequency of 24,960 Hz. and after dividing that in half again lead 34 has a frequency of 12,480 Hz.

The signal on lead 35 is produced by dividing by three the signal appearing on lead 33 such that lead 35 contains a signal with a frequency of 8,320 Hz. The latter is divided by eight to produce the signal on lead 36 having a frequency of 1,040 Hz., and this in turn is divided by two to produce the signal on lead 37 with a frequency of 520 Hz.

The squarewave signal at a frequency of 520 Hz. on lead 37 is fed through two bi-quadratic bandpass filters 38 to furnish lead 29 with a sine wave signal at a frequency of 520 Hz. that is relatively free of harmonic content. Any residual harmonic content in the signal on lead 29 will be further suppressed due to the tuning of the transmitter antenna coils 21 and 22 by capacitor 24.

a vertical direction, the detected signal strength of the second harmonic will be approximately −45 db while with only a 10° inclination of the tag away from the vertical the second harmonic signal strength will now be approximately −20 db. Thus, it will be seen that for a very slight departure from the vertical there is a significant increase in detected signal affording reliable detection of the tag or target.

It should be apparent from the foregoing description that if the tag is provided with means for selectively suppressing the second harmonic component of the signal that it will be possible to activate or deactivate the tag as desired. Such means are believed to be well know.

When adjusting the receiver, without a tag or target in the surveillance zone, the signal from the variable phase shifter 69 is adjusted in phase until a minimum DC voltage level appears at the output of phase comparator 67. A minimum output implies that the received second harmonic signal component is 180° out of phase with regard to the reference signal.

Having described the invention with reference to the presently preferred embodiment thereof, it will be understood by those skilled in the subject art that various changes in construction and materials may be effected without departing from the true spirit of the invention as defined in the appended claims.

What is claimed is:

1. Apparatus for detecting the presence within a surveillance zone of a body of high permeability material, the latter being constructed, when linked in said zone with both a magnetic field varying at a fundamental frequency and the substantially constant magnetic field of the earth, to produce a detectable signal containing both odd and even harmonics of said fundamental frequency, said apparatus comprising means for establishing in said zone said varying magnetic field, means for coupling to said zone to detect signals produced by said body, means coupled to said coupling means for separately determining for a detected signal the respective amplitude of a first and second component thereof whose respective frequencies are equal to two different harmonics of said fundamental frequency, one harmonic being odd and the other being even, said determining means including means for determining the phase of said first component, and means coupled to all of said determining means for furnishing an indication of the presence of said body within said zone whenever said amplitudes and phase simultaneously fall within respective predetermined limits.

2. Apparatus according to claim 1, wherein the frequency of said first component is equal to an even harmonic of said fundamental frequency.

3. Apparatus according to claim 2, wherein the frequency of said first component is equal to the second harmonic of said fundamental frequency.

4. Apparatus according to claim 3, wherein the frequency of said second component is equal to the third harmonic of said fundamental frequency.

5. Apparatus according to claim 2, wherein the frequency of said second component is equal to the third harmonic of said fundamental frequency.

6. Apparatus according to claim 1, wherein said fundamental frequency is about 520 Hz.

7. Apparatus according to claim 6, wherein the frequency of said first component is about 1040 Hz.

8. Apparatus according to claim 7, wherein the frequency of said second component is about 1560 Hz.

9. Apparatus according to claim 6, wherein the frequency of said second component is about 1560 Hz.

10. Apparatus for detecting the presence within a surveillance zone of a body of high permeability material, the latter being constructed, when linked in said zone with both a magnetic field varying at a fundamental frequency and the substantially constant magnetic field of the earth, to produce a detectable signal containing both odd and even harmonics of said fundamental frequency, said apparatus comprising means for establishing in said zone said varying magnetic field, means for coupling to said zone to detect signals produced by said body, first filter means coupled to said coupling means for attenuating all signals having a frequency less than the second harmonic of said fundamental frequency, second filter means coupled to an output of said first filter means for passing only those signals having a frequency substantially equal to the third harmonic of said fundamental frequency, third filter means coupled to an output of said first filter means for passing only those signals having a frequency substantially equal to the second harmonic of said fundamental frequency, means coupled to an output of said second filter means for determining if the signals therefrom have an amplitude within a given range, means coupled to an output of said third filter means for determining if the signals therefrom have an amplitude within a given range, further means coupled to an output of said third filter means for producing squarewave signals therefrom and determining whether the deviation in phase of said squarewave signals from the phase of a reference signal falls within a given range, and means coupled to all of said determining means for furnishing an indication of the presence of said body within said zone whenever all of the signals therefrom fall within their respective given ranges.

11. Apparatus according to claim 10, wherein said second and third filter means each include a commutating comb filter synchronized with said means for establishing said varying magnetic field.

12. Apparatus according to claim 1, wherein said means for establishing said varying magnetic field and said means to detect signals produced by said body comprise an integrated antenna structure containing both transmitting and receiving coils equally divided between two panels which panels are constructed and arranged to be mounted in parallel planes on opposite sides of a pathway containing said surveillance zone, said panels each containing a transmitting coil in the shape of a rhomboid and a receiving coil in the shape of a figure "8", the latter being balanced to cause cancellation of any signal received directly from its associated transmitting coil.

13. Apparatus according to claim 12, wherein said transmitting coils are congruent, the shorter diagonal of each rhomboid being perpendicular to the shorter sides of the respective rhomboid, and said panels are constructed and arranged to be mounted with said shorter diagonals lying in a common plane normal to the planes to said rhomboids and with the lower diagonals of said rhomboids lying in separate planes that intersect each other and said common plane along a common straight line.

14. Apparatus according to claim 13, wherein said means for establishing said varying magnetic field further comprises a source of signals at said fundamental frequency, and means for connecting said transmitting Returning to FIG. 4, it will be seen that the receiving coils 25 and 26 are connected over lead 27 to the input of a high pass filter 39 whose output is furnished to the input of a 35 db gain low noise amplifier 40 from which the signal is fed in parallel to the respective inputs of bandpass filters 41 and 42. The bandpass filter 41 has a center frequency of 1,040 Hz. while the bandpass filter 42 has a center frequency of 1,560 Hz. That is, bandpass filter 41 is tuned to the second harmonic of the transmitter frequency of 520 Hz. while bandpass filter 42 is tuned to the third harmonic thereof.

The output from bandpass filter 41 is furnished through a 70 db gain amplifier 43 to the input of a commutating filter 44. Filter 44 is furnished with a squarewave signal having a frequency of 1,040 Hz. over a lead 45 from an output of a scaling circuit 46 that is furnished with the 8,320 Hz. squarewave signal from lead 35. Thus, it will be seen that scaling circuit 46 divides the input signal from lead 35 by eight to provide the output signal on lead 45.

In similar fashion the signal from bandpass filter 42 is furnished through a 70 db gain amplifier 47 to one input of a commutating filter 48 having a second input furnished over lead 49 with a squarewave signal having a frequency of 1,560 Hz. The latter signal is obtained from a scaling circuit 50 whose input is connected to lead 34. Scaling circuit 50 also divides its input signal by eight.

Commutating filter 48 has a transfer characteristic with a high "Q" sharply tuned to a center frequency of 1,560 Hz. Its sine wave output over lead 51 is furnished through an AC-DC converter 52 to a window voltage comparator 53. The output from window voltage comparator 53 is fed over lead 54 to one input of an AND gate 55 that has an output 56 coupled to an alarm circuit 57.

Similarly, commutating filter 44 has a transfer characteristic with a high "Q" sharply tuned to a center frequency of 1,040 Hz. and having a sine wave output fed over lead 58 through AC-DC converter 59 to a window voltage comparator 60. The output from window voltage comparator 60 is furnished over a lead 61 to one input of an ADD circuit 62 whose output over lead 63 supplies the second input to AND gate 55.

The output from commutating filter 44 over lead 58 is also furnished over a lead 64 to the input of a squaring amplifier 65 for producing a squarewave signal that is fed over lead 66 to one input of a phase comparator 67. The other input to phase comparator 67 is obtained over lead 68 from an output of a variable phase shifter 69. The output of phase comparator 67 is fed over lead 70 through a window voltage comparator 71 to lead 72 feeding the second input to ADD circuit 62.

The variable phase shifter 69 may take the form of a digital shift register that receives its clock signal over lead 33 and its input signal over lead 36, previously described with reference to FIG. 5.

The receiver portion of the circuit is completed by a power-up reset circuit 73 whose output is furnished over a lead 74 to another input to alarm circuit 57.

Referring again to FIG. 5, the crystal oscillator 31 may take the form of a crystal controlled multivibrator for providing a squarewave signal to scaling circuits 32.

Returning to FIG. 4, the high pass filter 39 may be of passive construction and is arranged to attenuate frequencies below 1 KHz. This serves to eliminate any spurious signals having frequencies below the second harmonic of the transmitter frequency of 520 Hz. This includes elimination of any spurious 60 Hz. signal and the lower harmonics thereof.

The following low noise amplifier 40 provides amplification and buffering for feeding the parallel inputs to the two bandpass filters 41 and 42. The latter filters may also be passive and further reduce undesired signals while passing signals at the desired second and third harmonic frequencies of 1,040 and 1,560 Hz.

Further amplification is then provided by the amplifiers 43 and 47 such that the total amplification from the high pass filter 39 to the input to the commutating filters 44 and 48, in each channel, is on the order of 105 db.

The commutating filters 44 and 48 provide the major rejection of unwanted signals. At the same time, these filters are caused to track the signals from source 30 so as to compensate for any variations in the transmitted frequency. Each commutating filter, 44 and 48, contains a respective low "Q" bandpass filter to reduce harmonics generated by the "comb" effect of the commutating filter. It is believed that such comb type commutating filters are well known digital components and need not be described further herein.

The sinusoidal signals at the output of the commutating filters are then converted to DC by the respective converters 52 and 59 in any convenient manner. After appropriate buffering (not shown) the signals are fed to the window voltage comparators 53 and 60 which are preset to pass signals to their respective output leads 54 and 61 only when the signals at their input occur within a predetermined range. Such range is predetermined on the basis of the characteristic of the target that is to be detected.

As mentioned previously, squaring amplifier 65 produces a squarewave from the sinusoidal signal at its input in order to furnish the same to the phase comparator 67. The phase comparator 67 may take the form of an exclusive OR gate. Its output is furnished to the window voltage comparator 71 that also responds to a predetermined range of input signals for providing its output on lead 72 to the ADD circuit 62. Only when the outputs from all three window voltage comparators 53, 60 and 71 occur simultaneously will AND gate 55 provide an output over lead 56 to energize alarm circuit 57. The function of power-up reset circuit 73 is to disable the alarm 57 for a brief period, for example, six seconds, as the power is initially turned on to the system. This is to prevent production of a false alarm during this initial period.

In a typical system constructed in accordance with the present invention the power amplifier 28 was arranged to supply the transmitter coils 21 and 22 with approximately 8 watts RMS power. The relative geometry of the receiver and transmitter coils with their mounting provide attenuation of from 40 to 80 db with regard to the direct path therebetween. The earth's magnetic field is assumed to fall within the range of about 0.5 oersted. Satisfactory operation has been achieved employing a tag or a marker having a body of high permeability material in the form of a ribbon or strip three inches long by 0.070 inches wide by 0.0023 inches thick formed from a material having a maximum permeability of approximately 180,000. The coercivity of said material is about 0.035 oersted. When such body is introduced into the space between the panels 10 and 11 and the system is energized an alarm will be initiated. It has been determined experimentally that with the described antenna configuration, when the tag as described above is oriented between the antenna panels in coils of said two panels in a series resonant circuit to an output of said source.

15. Apparatus according to claim 12, wherein said means for establishing said varying magnetic field further comprises a source of signals at said fundamental frequency, and means for connecting said transmitting coils of said two panels in a series resonant circuit to an output of said source.

16. Apparatus according to claim 1, wherein said means for establishing said varying magnetic field comprise a pair of transmitting coils, a source of signals at said fundamental frequency, and means for connecting said transmitting coils in a series resonant circuit to an output of said source.

* * * * *